US007750808B2

(12) United States Patent
Masino et al.

(10) Patent No.: US 7,750,808 B2
(45) Date of Patent: Jul. 6, 2010

(54) DATA RETRIEVAL TAGS

(75) Inventors: James Masino, Houston, TX (US); Li Gao, Missouri City, TX (US); Chris Golla, Houston, TX (US); Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1461 days.

(21) Appl. No.: 11/124,030

(22) Filed: May 6, 2005

(65) Prior Publication Data

US 2006/0250243 A1 Nov. 9, 2006

(51) Int. Cl.
*G08B 13/14* (2006.01)
*E21B 47/01* (2006.01)

(52) U.S. Cl. ..... 340/572.1; 340/853.1; 340/853.8; 340/854.3; 73/152.03; 166/254.2; 367/81

(58) Field of Classification Search ..... 340/572.1, 340/853.1, 853.3, 853.4, 853.7, 853.8, 854.3; 367/81, 83, 84; 73/152.03, 152.31, 152.01, 73/152.02; 166/255.1, 254.2, 66
See application file for complete search history.

(56) References Cited

U.S. PATENT DOCUMENTS

| | | | | |
|---|---|---|---|---|
| 6,604,063 | B2 | 8/2003 | Denny et al. | |
| 6,691,779 | B1 | 2/2004 | Sezginer et al. | |
| 6,693,553 | B1 | 2/2004 | Ciglenec et al. | |
| 6,736,210 | B2 | 5/2004 | Hosie et al. | |
| 6,802,373 | B2 * | 10/2004 | Dillenbeck et al. | 166/255.1 |
| 7,017,662 | B2 * | 3/2006 | Schultz et al. | 166/254.2 |
| 7,385,523 | B2 * | 6/2008 | Thomeer et al. | 340/854.8 |
| 2008/0007421 | A1 * | 1/2008 | Liu et al. | 340/853.3 |

OTHER PUBLICATIONS

International Search Report for PCT/US206/17642 mailed Mar. 27, 2007.

* cited by examiner

*Primary Examiner*—Davetta W Goins
(74) *Attorney, Agent, or Firm*—Baker Botts L.L.P.

(57) ABSTRACT

Data retrieval tags, drillstring communications systems and methods, and computer programs are disclosed. The data retrieval tag includes an insulator substrate, at least one analog memory cell disposed on the insulator substrate and an antenna coupled to the analog memory.

17 Claims, 10 Drawing Sheets

DATA RETRIEVAL TAGS

BACKGROUND

As activities conducted in high-temperature environments, such as well drilling, becomes increasingly complex, the importance of including electronic circuits for activities conducted in high-temperature environments increases.

In certain situations, it is useful to measure one or more properties (e.g., temperature or pressure) downhole and transmit the measured properties to a surface processor. It may be desirable to use different sensors without changing the composition of the drillstring in the borehole.

In other situations, it may be useful to provide communications between two or more nodes on a drillstring without providing a dedicated or permanent communications medium between the nodes.

Semiconductor based components, including Complementary Metal Oxide Semiconductor (CMOS) devices, may exhibit increased leakage currents at high temperatures. For example, conventional bulk-silicon CMOS devices may exhibit increased leakage currents, and hence decreased resistances, in response to an increase in the environmental temperature of the device.

DETAILED DESCRIPTION

Figure 1:
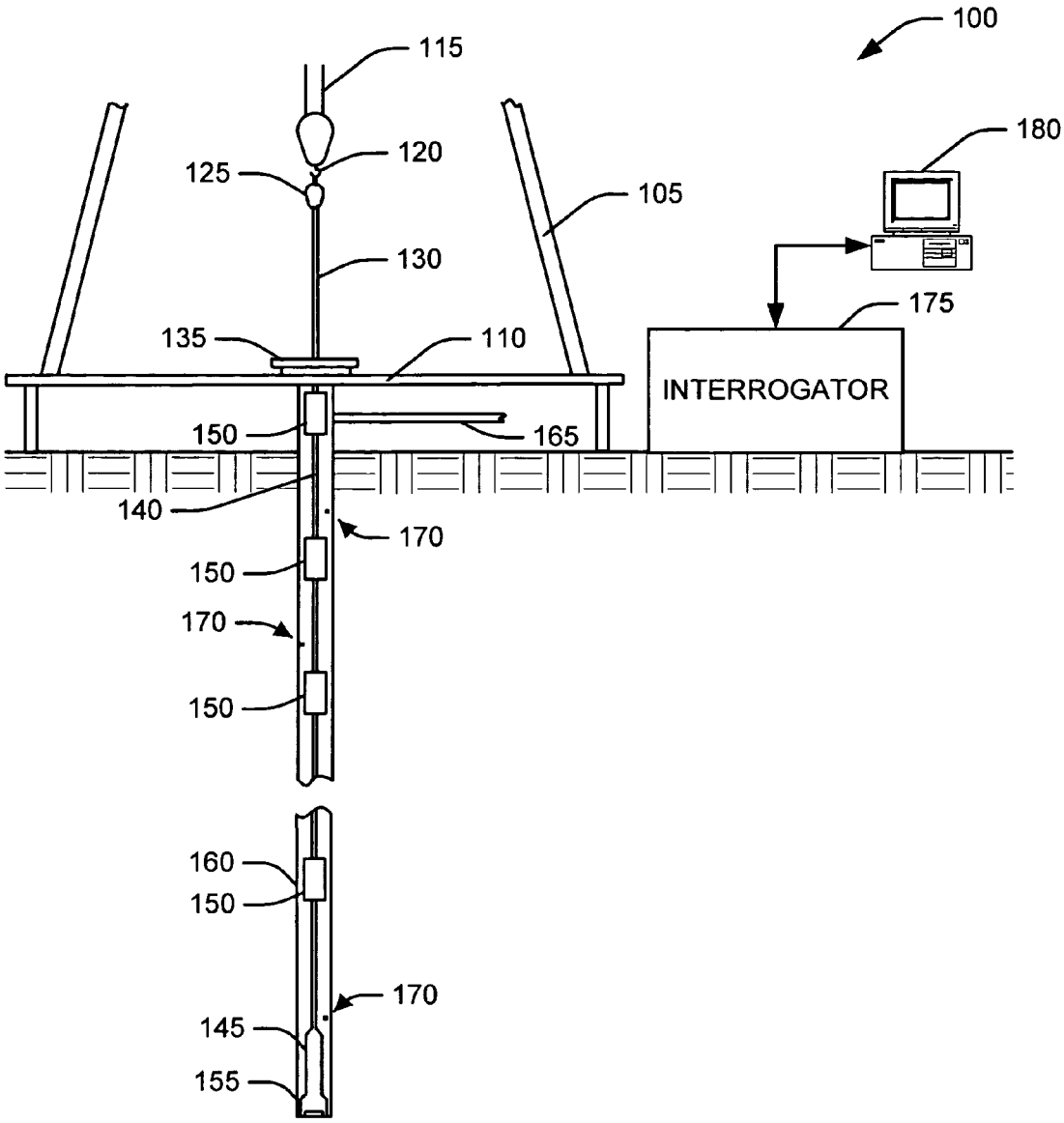
FIG. 1 a diagram of an oil-well drilling apparatus.

As shown in FIG. 1, oil well drilling equipment 100 (simplified for ease of understanding) includes a derrick 105, derrick floor 110, draw works 115 (schematically represented by the drilling line and the traveling block), hook 120, swivel 125, kelly joint 130, rotary table 135, drillpipe 140, drill collar 145, subs 150, and drill bit 155. Drilling fluid, such as mud, foam, or air, is injected into the swivel by a drilling fluid supply line (not shown). The drilling fluid travels through the kelly joint 130, drillpipe 140, drill collars 145, and subs 150, and exits through jets or nozzles in the drill bit 155. The drilling fluid then flows up the annulus between the drill pipe 140 and the wall of the borehole 160. A drilling fluid return line 165 returns drilling fluid from the borehole 160 and circulates it to a drilling fluid pit (not shown) and back to the drilling fluid supply line (not shown). The combination of the drill collar 145 and drill bit 155 is known as the bottomhole assembly (or "BHA"). The combination of the BHA and the drillpipe 140 is known as the drillstring. In rotary drilling the rotary table 135 may provide rotation to the drill string, or alternatively the drill string may be rotated via a top drive assembly. The term "couple" or "couples" used herein is intended to mean either an indirect or direct connection. Thus, if a first device couples to a second device, that connection may be through a direct connection, or through one or more intermediate devices.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. As used herein, "oil well drilling equipment" also includes fracturing, workover, and other downhole equipment.

Also shown in FIG. 1 are data retrieval tags 170. The data retrieval tags 170 may be circulated in the drilling fluid though the borehole 160. In general, in certain embodiments, the data retrieval tags 170 may be used to measure one or more properties while traveling in the drilling fluid 160. In general, in other embodiments, the data retrieval tags 170 may be used as store-and-forward signaling devices for communication between elements in the oil well drilling equipment 100.

Figure 2:
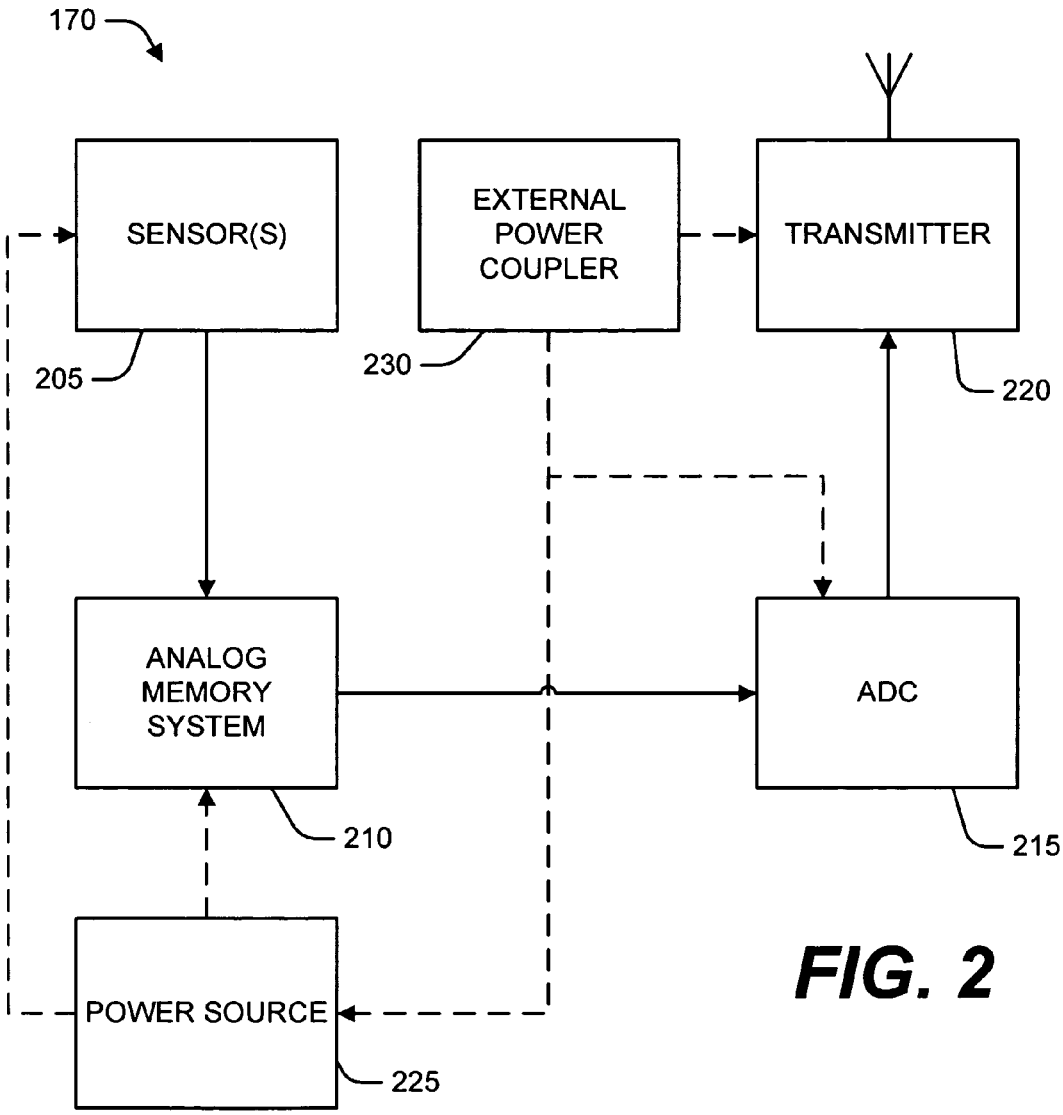
FIG. 2 is a block diagram of a data retrieval tag.

A block diagram of a data retrieval tag 170 to place in the borehole 160 is shown in FIG. 2. The data retrieval tag may include one or more sensors 205 to measure one or more properties downhole and generate one or more signals that are representative of the measured properties. For example, the sensors 205 may be pressure sensors to sense pressures and generate signals indicative of the measured pressures. Other sensors 205 may include, for example, temperature sensors, humidity sensors, mass flow sensors, resistivity sensors, porosity sensors, or other sensors. The sensors 205 may sense and measure one or more other downhole properties. One or more sensors may output their signals to an analog memory system 210 (which is shown in greater detail in FIG. 3). In general, the analog memory system 210 may store one or more voltages indicative of the signals received from the one or more sensors 205. Some example analog memory systems 210 may be read from or written to in serial. Other example analog memory systems 210 may be read from or written to in parallel.

The data retrieval tag 170 may include a power source 225 to power one or more of the sensors 205 and the analog memory system 210. The power source 225 may be couple to and receive power from an external power coupler 230. The external power coupler 230 may, in turn, receive power from an external power source and couple the power to one or more of the transmitter 220, the analog-to-digital converter (ADC) 215, and the power source 225. In certain example implementations, the external power coupler may recharge the power source 225, to allow the power source 225 to power one or more components in the data retrieval tag 170 while the external power coupler 230 is not coupling power from an external power source. For example, the power source may provide power to the analog memory system 210 and the one or more sensors 205 while the data retrieval tag 170 is circulating in the drilling fluid without power from the external power coupler 230.

The data retrieval tag 170 may include the ADC 215. The input of the ADC 215 is coupled to the analog memory system 210 to produce a digital representation of the analog signal from the analog memory system 210. Other example data retrieval tags 170 may operate without the ADC 215, where, for example, the transmitter 220 transmits an analog signal using an antenna. In these data retrieval tags 170, the output of the analog memory system may be coupled to the transmitter 220.

Portions of the data retrieval tag 170, such as the ADC 215 and the transmitter 220 and the power source 225, may be coupled to an external power coupler 230. The external power coupler 230 is generally coupled to, or within, the data retrieval tag 170. The external power coupler 230 may receive power from an external power source to power one or more components in the data retrieval tag 170. The external power source may be located downhole or at the surface. The power source 225 may be recharged by power from the external power coupler 230. The external power coupler 230 may include one or more coils, magnetic device, piezo-electric devices, or other devices or combinations of devices to receive power from one or more external power sources. In addition to providing power to the transmitter 220 and the ADC 215, the external power coupler may also signal the transmitter 220 or the ADC 215 to read output from the analog memory system 210 and to transmit.

In general, the transmitter 220 may transmit digital or analog signals indicative of the output of the analog memory system 210. For example, the transmitted signals may be Amplitude Shift Keying (ASK), Phase Shift Keying (PSK), Frequency Shift Keying (FSK), or Ultra wideband (UWB) signals. In some implementations, the transmitter 220 may transmit an analog signal based on the output of the analog memory system 210. In one example implementation, the output of the analog memory system 210 may be connected to the input of the transmitter 220. The output of the analog memory system may control one or more of the amplitude, frequency, or duration of signals produced by the transmitter 220.

Figure 3:
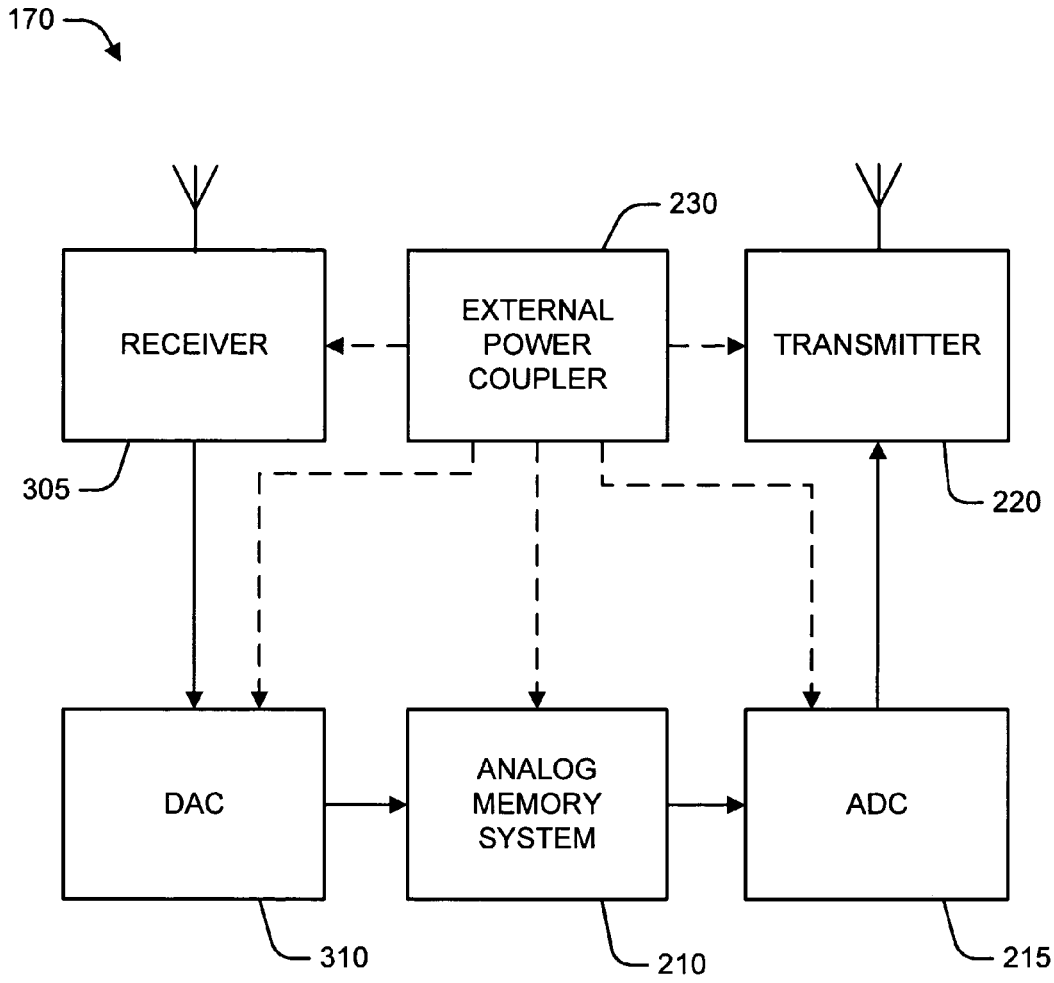
FIG. 3 is a block diagram of a data retrieval tag.

Another example data retrieval tag 170 is shown in FIG. 3. In the block diagram, the solid lines between elements represent channels for passing information while the broken lines represent channels for providing power.

As illustrated in FIG. 3, the data retrieval tag 170 may include a receiver 305 to receive one or more signals. The signals received by the data retrieval tag 170 may include commands to, for example, begin or stop measuring downhole properties, transmit recorded properties, transmit other recorded data. In certain implementations, the data received by the data retrieval tag 170 may be for retransmission to a node sub. In general, the received signals may be digital or analog. For example, the signals may be Amplitude Shift Keying (ASK), Phase Shift Keying (PSK), Frequency Shift Keying (FSK), or Ultra wideband (UWB) signals.

The output of the receiver 305 may be coupled to a Digital-to-Analog converter (DAC) 310. The DAC 310 may covert one or more digital signals received by the receiver 3 05 into analog signals for recording in the analog memory system 210. In certain example implementations, the receiver 305 may receive an analog signal that may be stored in the analog memory system 210 without the DAC 310.

As shown in FIG. 3, the data retrieval tag 170 may be fully powered by an external power source though the external power coupler 230. The external power coupler 230 may be coupled to transmitter 220, receiver 305, DAC 310, analog memory system 210, and ADC 215. The external power coupler 230 may receive power from an external power source and, in turn, provide power to one or more components in the data retrieval tag 170.

Figure 4:
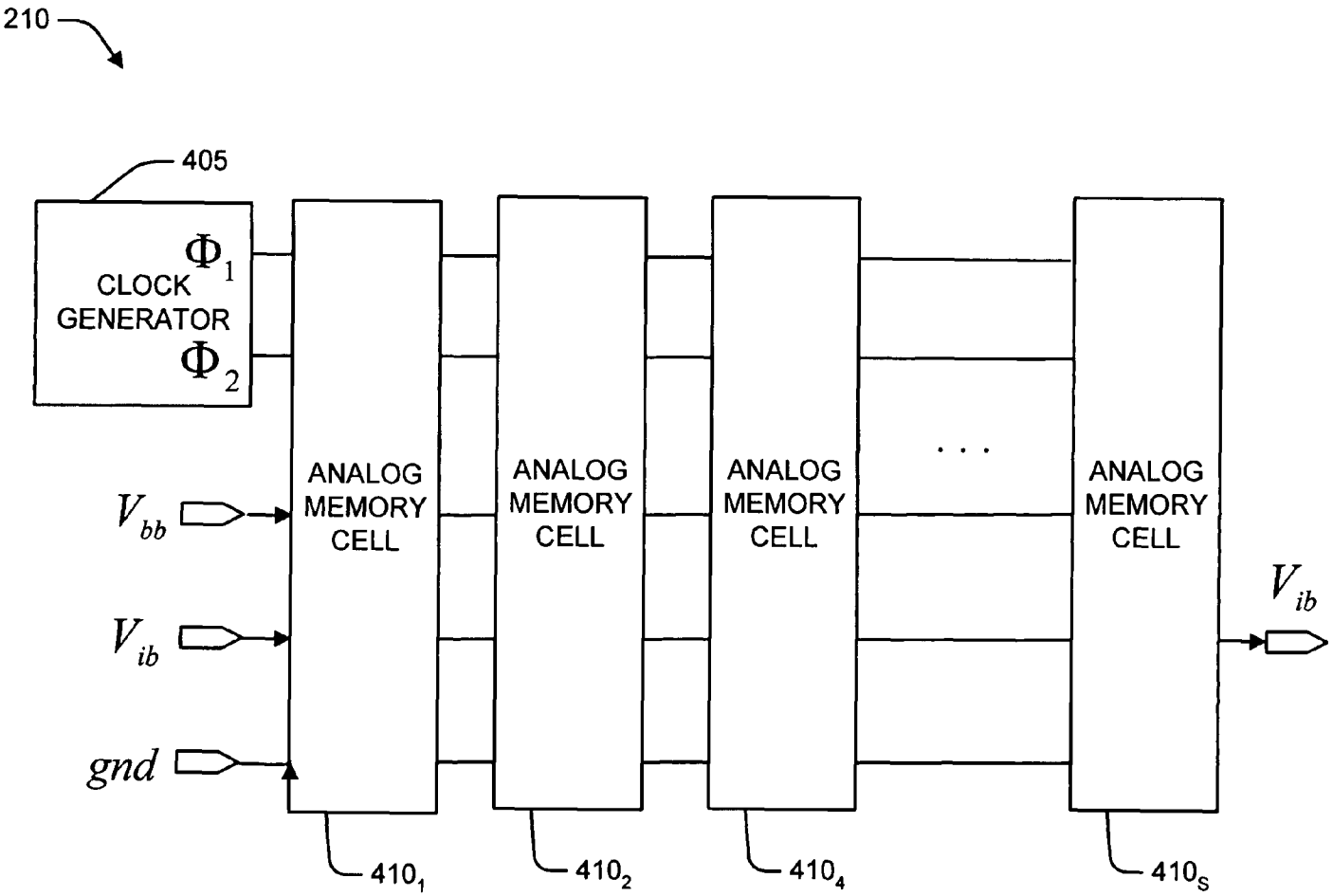
FIG. 4 is a block diagram of an analog memory system.

FIG. 4 is a block diagram of an example analog memory system 210. The analog memory system 210 may include one or more clocks to generate one or more clock signals, such as $\Phi_1$ and $\Phi_2$. In this example system $\Phi_1$ and $\Phi_2$ are out of phase (e.g., by 175°). In addition to the clock signals, the analog memory system 210 may receive or provide a voltage $V_{bb}$, which may be referred to as the transport tetrode gate bias. The analog memory system 210 may receive an input voltage $V_{ib}$. The analog memory system 210 includes one or more analog memory cells $\mathbf{410}_{1 \ldots S}$ (which are shown in greater detail in FIG. 5). Each of the analog memory cells $\mathbf{410}_{1 \ldots S}$ may store an analog value. The array of analog memory stages $\mathbf{410}_{1 \ldots S}$ may be referred to as a bucket brigade, due to the sequential shifting of values between the memory stages $\mathbf{410}_{1 \ldots S}$.

Figure 5:
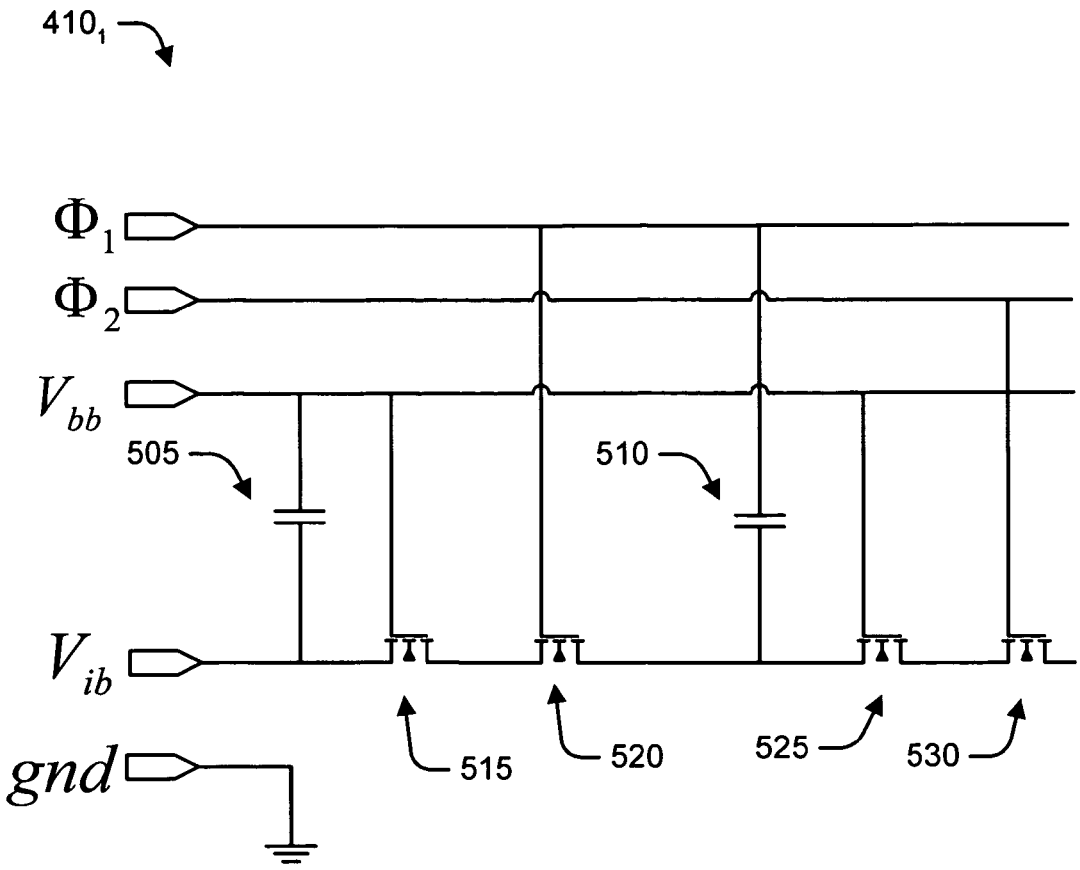
FIG. 5 is a schematic diagram of an analog memory stage.

An example memory cell $\mathbf{410}_1$ is shown in FIG. 5. The memory cell $\mathbf{410}_1$ may include one or more capacitors, such as capacitors 505 and 510. The memory stage may also include one or more transistors, such as transistors 515, 520, 525, and 530. The memory stage $\mathbf{410}_1$ is designed to sequentially sample $V_{ib}$ and shift the sampled value to the succeeding memory stage (e.g. $\mathbf{410}_2$), or, in the case of the final analog memory cell $\mathbf{410}_S$, to output the stored value. In some implementations, the values stored in the memory cells $\mathbf{410}_{1 \ldots S}$ may be read or written substantially simultaneously. In other implementations, values in the analog memory cells $\mathbf{410}_{1 \ldots S}$ may be read or written sequentially. Likewise, in some implementations, the memory stages $\mathbf{410}_{1 \ldots S}$ may be written to in parallel.

In some implementations, the data retrieval tag 170 may be exposed to high temperatures, which may cause an increased leakage current in the memory stages $\mathbf{410}_{1 \ldots S}$. All, or part of, the analog memory system 210 may be fabricated on an insulator substrates to minimize leakage currents. For example, the analog memory stages $\mathbf{410}_{1 \ldots S}$ may be fabricated on an insulator substrate that exhibits a leakage current that is less than the leakage current of a silicon substrate. Example insulator substrates substrate may include at least one of sapphire or silicon carbide. Fabrication techniques may include thin-film silicon on insulator (SOI) or silicon on sapphire (SOS) fabrication, separation by implantation of oxygen (SIMOX) fabrication, or back-etched silicon on insulator (BESOI) fabrication. Other portions of the data retrieval tag 170 may be fabricated in bulk silicon, or the entire data retrieval tag 170 may be fabricated on the insulator substrate.

Returning to FIG. 1, the oil well drilling equipment 100 may include an interrogator 175 to receive stored memory values transmitted from data retrieval tags 170. For example, the interrogator may be positioned near the drilling fluid pit to communicate with the data retrieval tags 170. The interrogator 175 may include a power source to provide power to the data retrieval tags 170 via the external power coupler 230. The interrogator 175 may include a receiver to receive signals from the data retrieval tags 170. In some implementations where the data retrieval tags 170 receive a signal before they transmit stored measurements from their analog memory system 210, the interrogator 175 may include a transmitter to signal the data retrieval tags to send stored measurements. The interrogator 175, or another portion of the well drilling equipment 100 may send a signal to the data retrieval tags 170 to transmit or receive measurements. In some implementations, this signaling may include providing some power to the data retrieval tags 170. This power provided to each data retrieval tag 170 may be used to power the power source 225.

The interrogator 175 (FIG. 1) may be coupled to a terminal 180. The terminal 180 may record stored measurements received from the data retrieval tags 170. The terminal 180 may be interactive and allow a user to alter the behavior of the system, or the terminal 180 may be passive.

Figure 6:
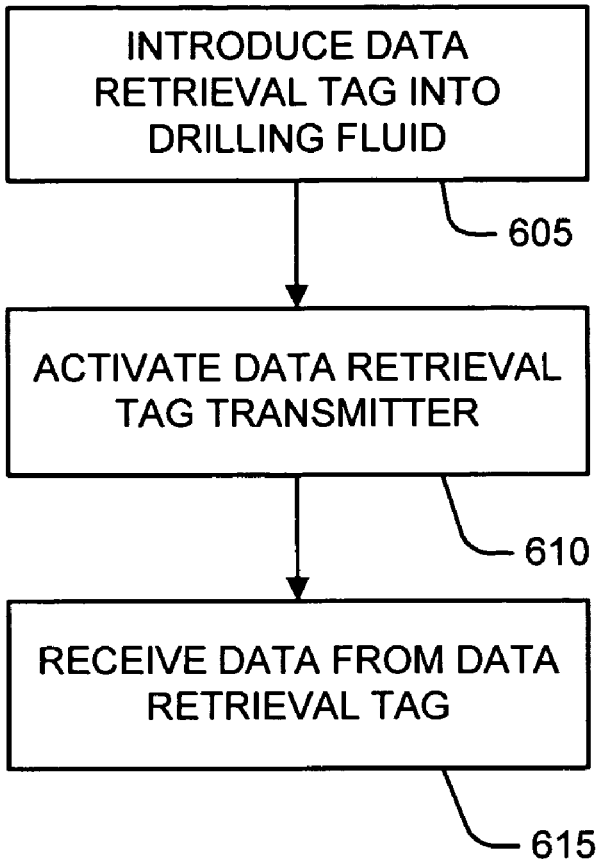
FIGS. 6-7 are flow charts of a data retrieval tag method of operation in a drillstring communication system.

An example method of using a data retrieval tag 170 is shown in FIG. 6. The example method may be used with oil well drilling equipment 100, shown in FIG. 1. The data retrieval tag 170 may be introduced into the drilling fluid so that the data retrieval tag 170 will circulate through the borehole 160 (block 605). The data retrieval tag 170 may be activated, so that it will measure and record one or more property values (block 610). Once the data retrieval tag 170 returns to the surface (e.g., though the drilling fluid return line 165), the interrogator 175 may receive data from the data retrieval tag 170 (block 815).

Figure 7:
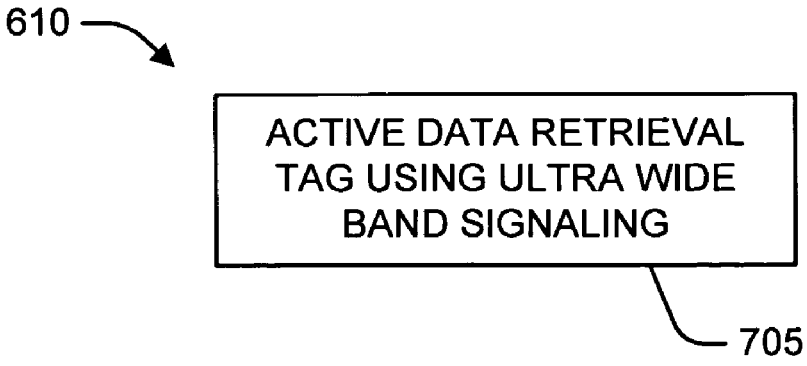
Figure 8:
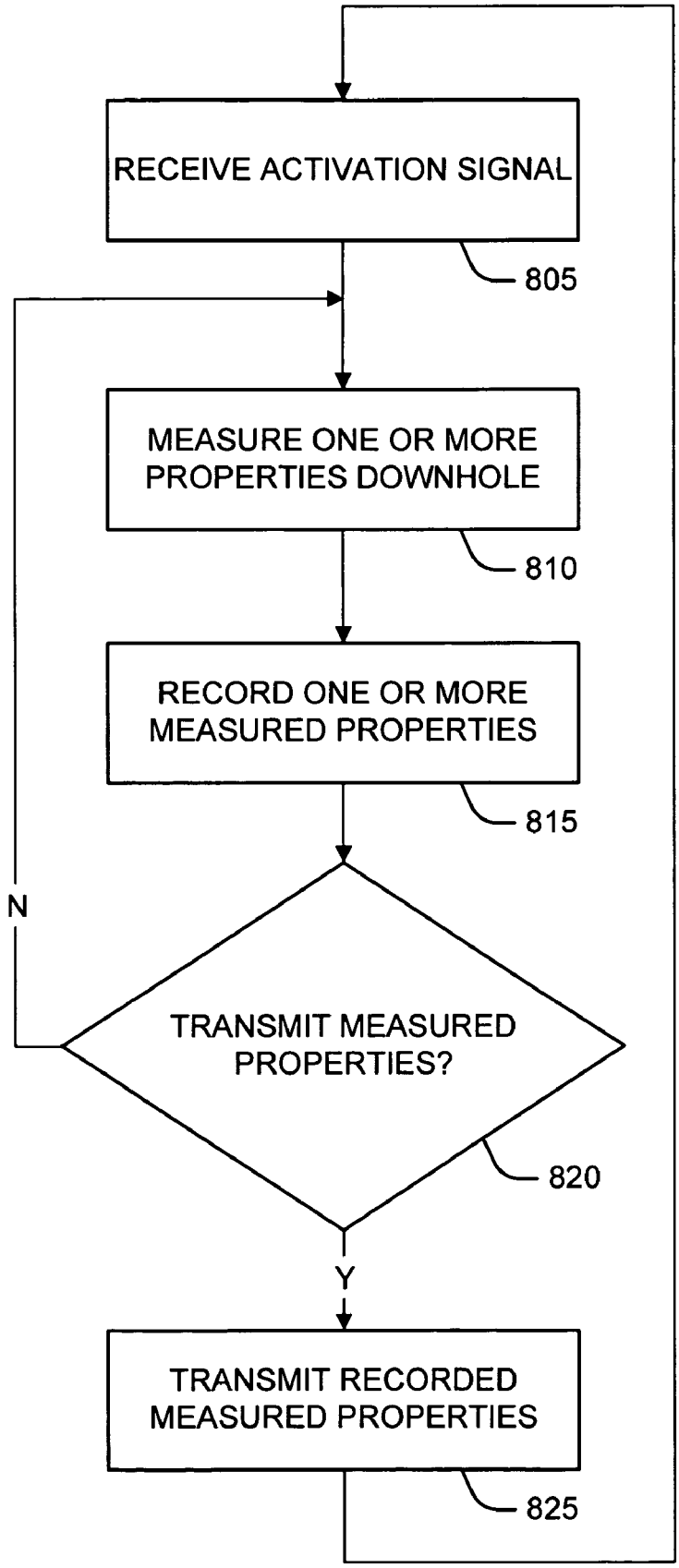
FIGS. 8-9 are flow charts of a data retrieval tag method of operation.

An example method of activating the data retrieval tag 170, so that it measures and records one or more sensor measurements (block 610) is shown in FIG. 7. An Ultra Wide Band (UWB) signal may be sent to the data retrieval tag 170 to signal the data retrieval tag 170 to record one or more property values (block 705). In certain implementations, UWB signaling may be used to send other data or commands to the data retrieval tag 170. In certain example implementations, the data retrieval tag 170 may be activated at or near the surface. In other example implementations, the data retrieval tag 170 may be activated downhole. In other implementations, the data retrieval tag 170 may be programmed to activate after a programmable interval An example method of operation of a data retrieval tag 170 is shown in FIG. 8. The data retrieval tag receives an activation signal (block 805). The data retrieval tag 170 measures (block 810) and records (block 815) one or more downhole properties received from one or more sensors 205 while it is immersed in the drilling fluid. If the data retrieval tag receives a signal to transmit the measured properties it has recorded (block 820), it does so (block 825), otherwise it returns to block 810 to continue receiving sensor measurements.

Figure 9:
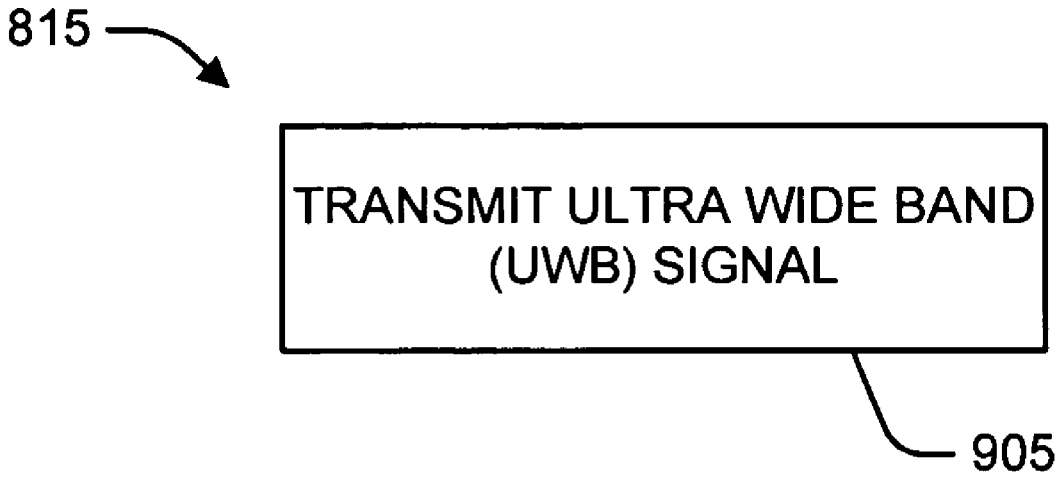

An example method of transmitting one or more measured properties (block 825) is shown in FIG. 9. The data retrieval tag 170 may transmit the measured properties as a ultra wide band (UWB) signal (block 905). Other transmissions from the data retrieval tag 170, such as transmission of information to communication nodes, may be UWB signals.

Figure 10:
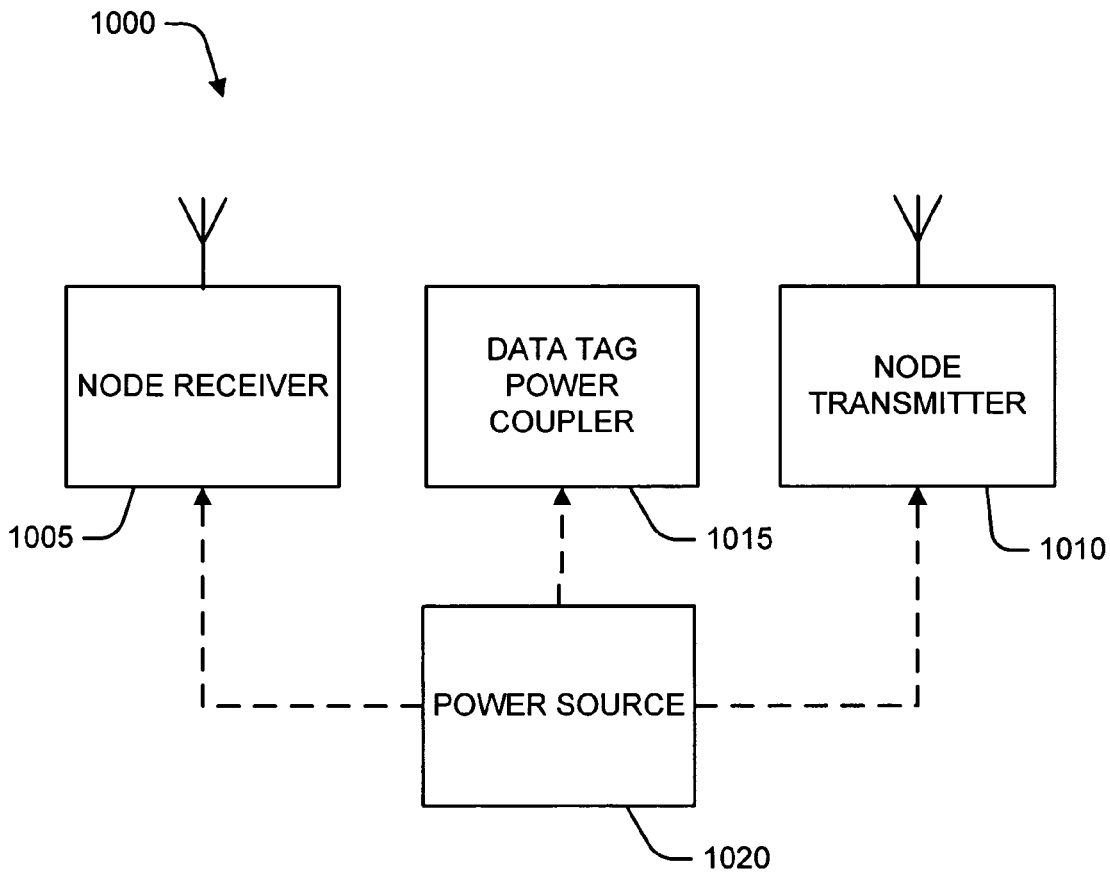
FIG. 10 is a block diagram of a drillstring communication system node.

In certain implementations, the data retrieval tags 170 may be used to facilitate (e.g., transmit or receive) communication between communication nodes disposed on the drillstring. For example, communication nodes may be disposed on or in the drillpipe 140, subs 150, drill collar or collars 145, or the bit 155. A block diagram of a communication node is shown in FIG. 10. The example communication node, indicated generally at 800, includes a node receiver 1005 to receive a signal from a data retrieval tag 170. The communication node 800 may include a node transmitter 1010 to send a signal to a data retrieval tag 170. The communication node may include a data tag power coupler 1015 to provide power from a power source 1020 to the data retrieval tag 170.

Figure 11:
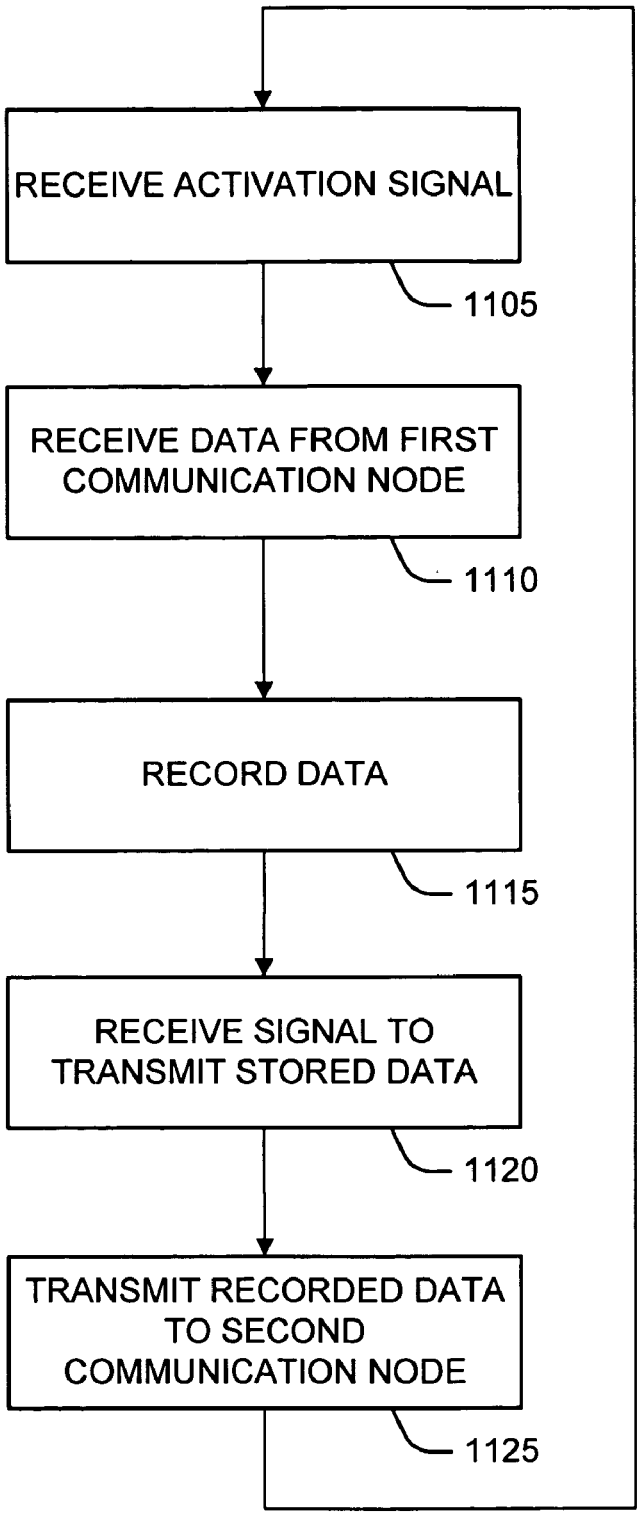
FIG. 11 is a flow chart of a method for logging using one or more data retrieval tags.

An example method of signaling between nodes on a drillstring is shown in FIG. 11. In general, the data retrieval tag 170 will be immersed in the drilling fluid. The data retrieval tag 170 may receive an activation signal (block 1105) and receive data from a first communication node. The data retrieval tag 170 may receive data from the first communication node (block 1110) and record the data in the analog memory system 215 (block 1115). The data retrieval tag may wait to receive a signal to transmit the stored data (block 1120). Upon receiving a signal to transmit its stored data (block 1120), the data retrieval tag 170 may transmit the stored data (block 1125) and return to block 1105.

In certain implementations, the order of the method shown in FIG. 11 may be altered. For example, the data retrieval tag 170 may transmit stored data (block 1120), before receiving data from the first communications mode (block 1110).

In some implementations the data retrieval tags 170 may be used to pass data between communication nodes downhole. In other implementations, the data retrieval tags 170 may be used to pass data from at least one communication node 600 downhole to the interrogator 175 or another device at the surface.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

The invention claimed is:

1. A drillstring communication system, comprising:

a drillpipe comprising one or more joints, where the drillpipe is at least partially disposed in a drilling fluid;

at lest one data retrieval tag in the drilling fluid, the at least one data retrieval tag comprising:

an insulator substrate;

at least one analog memory cell disposed on the insulator substrate, the at least one analog memory cell having an input and an output;

a receiver having an output, where the receiver output is coupled to the analog memory input; and an antenna coupled to the analog memory output; and at least one communication node disposed along the drillpipe, the at least one communication nodes comprising:

a node transmitter to transmit a first signal to the at least one data retrieval tag; and a node receiver to receive a second signal from the at least one data retrieval tag.

2. The drillstring communication system of claim 1, wherein the at least one data retrieval tag further comprises:

an external power coupler to couple power from an external power source to at least one of: the at least one analog memory cell and the receiver.

3. The drillstring communication system of claim 1, wherein the antenna has an input and where the at least one data retrieval tag further comprises:

an analog-to-digital converter coupled between the analog memory output and the antenna input.

4. The drillstring communication system of claim 3, wherein the at least one data retrieval tag further comprises:

an external power coupler to couple power from an external power source to at least one of: the at least one analog memory cell and the receiver.

5. The drillstring communication system of claim 1, wherein the insulator substrate comprises at least one of silicon on insulator, sapphire, and silicon carbide.

6. The drillstring communication system of claim 1, wherein at least one node receiver and at least one data retrieval tag receiver receive Ultra Wide-Band (UWB) signals.

7. The drillstring communication system of claim 1, wherein at least one node transmitter and at least one data retrieval tag antenna transmit Ultra Wide-Band (UWB) signals.

8. The drillstring communication system of claim 1, wherein the at least one analog memory cell comprises:

at least one capacitor to store a signal; and at least one transistor to selectively discharge or charge the capacitor.

9. The drillstring communication system of claim 8, wherein the at least one analog memory cell comprises:

an input to receive the signal to store in the at least one capacitor; and an output to transmit the signal stored in the at least one capacitor.

10. The drillstring communication system of claim 1, wherein at least one drillstring node further comprises:

a power coupler to provide power to one or more data retrieval tags.

11. The drillstring communication system of claim 1, wherein the at least one data retrieval tag further comprises:

a digital-to-analog converter coupled between the receiver output and the analog memory input.

12. The drillstring communication system of claim 1, wherein the at least one data retrieval tag further comprises:

an external power coupler to couple power from an external power source to at least one of the analog memory, the receiver, and the digital-to-analog converter.

13. A data transfer method comprising:

releasing a data retrieval tag into drilling fluid circulating in a borehole, where the data retrieval tag is for:

receiving at least one signal;

storing the at least one signal in at least one analog memory cell, where the at least one analog memory cell is disposed on an insulator substrate; and transmitting the at least one signal stored in the at least one analog memory cell; and signaling the data retrieval tag to transmit data stored in the analog memory.

14. The data transfer method of claim 13, further comprising:

measuring at least one downhole property;

generating a signal responsive to the at least one downhole property; and activating the data retrieval tag to receive and record the at least one downhole property.

15. The data transfer method of claim 13, further comprising:

signaling the data retrieval tag to transmit at least one recorded signal.

16. The data transfer method of claim 13, further comprising:

signaling the data retrieval tag to receive and record at least one signal from a first communications node, the signal comprising data.

17. The data transfer method of claim 13, further comprising:

providing power to the data retrieval tag when the data retrieval tag returns to or near to the surface.

* * * * *